US005763801A

United States Patent [19]

Gulick

[11] Patent Number: 5,763,801

[45] Date of Patent: Jun. 9, 1998

[54] COMPUTER SYSTEM AND METHOD FOR PERFORMING WAVETABLE MUSIC SYNTHESIS WHICH STORES WAVETABLE DATA IN SYSTEM MEMORY

[75] Inventor: Dale E. Gulick, Austin, Tex.

[73] Assignee: Advanced Micro Devices, Inc., Sunnyvale, Calif.

[21] Appl. No.: 621,397

[22] Filed: Mar. 25, 1996

[51] Int. Cl.[6] ..... G10H 7/02

[52] U.S. Cl. ..... 84/604; 84/603; 84/621; 364/736

[58] Field of Search ..... 704/270; 84/604, 84/601

[56] References Cited

U.S. PATENT DOCUMENTS

| | | | |
|---|---|---|---|
| 5,283,386 | 2/1994 | Akutsu et al. . | |
| 5,311,458 | 5/1994 | Haines | 364/736 |
| 5,486,644 | 1/1996 | Kudo et al. . | |
| 5,539,145 | 7/1996 | Kuribayashi et al. . | |
| 5,553,011 | 9/1996 | Fujita . | |
| 5,659,466 | 8/1997 | Norris | 84/604 |
| 5,668,338 | 9/1997 | Hewitt | 84/604 |
| 5,689,080 | 11/1997 | Gulick | 84/604 |

FOREIGN PATENT DOCUMENTS

| | | |
|---|---|---|
| 0 483 970 | 5/1992 | European Pat. Off. . |
| 0 597 381 | 5/1994 | European Pat. Off. . |

OTHER PUBLICATIONS

Tom R. Halfhill, "The New PC," BYTE Magazine Cover Story, Oct. 1995, 6 pages.

The MIDI Manufacturers Association, Los Angeles, California., "Tutorial on MIDI and Music Synthesis," The Complete MIDI 1.0 Detailed Specification, Incorporating all Recommended Practices, document version 95.1, 1995, 24 pages.

International Search Report for PCT/US 97/02505 dated Jul. 11, 1997.

*Primary Examiner*—David R. Hudspeth

*Assistant Examiner*—Daniel Abebe

*Attorney, Agent, or Firm*—Conley, Rose & Tayon; B. Noel Kivlin

[57] ABSTRACT

A PCI-based system and method for performing wavetable music synthesis which uses system memory to store wavetable data is provided. The system and method utilize the benefits of the PCI bus while mitigating the disadvantages introduced by having to arbitrate for a shared system bus. By using system memory for storing wavetable data, a more cost effective personal computer audio system can be produced. In the preferred embodiment a computer system is provided that includes a system memory storing wavetable data samples, a PCI bus, and a PCI-based audio synthesis device. The audio synthesis device includes a PCI bus interface, a synthesizer, and a plurality of buffers coupled to the PCI bus interface and the synthesizer for transferring wavetable data samples between system memory and the synthesizer. The number of buffers defines the maximum number of voices which can simultaneously be active. The operation of the buffers is controlled by a buffer manager. The buffer manager, in conjunction with the buffer depth, maximizes allowed PCI bus latency by filling the active buffers when they have become a certain amount empty. By filling all active buffers in a given bus mastership, the device minimizes the total number of PCI bus mastership requests to a manageable value. Additionally, the audio synthesis device includes a plurality of write-back buffers coupled to the PCI bus interface, the buffer manager, and the synthesizer, for audio effects processing.

24 Claims, 9 Drawing Sheets

COMPUTER SYSTEM AND METHOD FOR PERFORMING WAVETABLE MUSIC SYNTHESIS WHICH STORES WAVETABLE DATA IN SYSTEM MEMORY

BACKGROUND OF THE INVENTION

1. Field of the Invention

This invention is related to the field of computer systems which perform music synthesis and, more particularly, to a computer system which includes wavetable synthesizer logic and which stores a plurality of wavetables of sampled data from a variety of voice sources in system memory.

2. Description of the Relevant Art

Personal computer (PC) audio systems have traditionally employed a technique called Frequency Modulation (FM) synthesis to generate audio sounds. FM synthesis works by combining the outputs of multiple sine wave oscillators which are relatively close in frequency to produce complex sound waves with close-to-natural timbres, attacks and delays. An advantage of FM synthesis is that it is relatively inexpensive to implement. A disadvantage is FM synthesized sounds are generally recognizable as synthesized sounds. A new music synthesis method, wavetable music synthesis, has the advantage of producing more life-like sounds than FM synthesis.

Wavetable music synthesizers store digitally sampled audio data in digital memory. Typically, wavetable synthesizers do not store a sample of each note which the instrument is capable of playing. Rather, to minimize the memory requirement, wavetable synthesizers typically store samples of a few representative notes of the instrument. For example, a wavetable music synthesizer might store eight of the eighty-eight possible notes of a piano. Wavetable synthesizers then retrieve one of these stored data samples, shift the pitch of the sampled data to the desired new pitch, and then perform digital-to-analog conversion on the new data so that an analog device such as a speaker or headphone can reproduce the original sound. Often many audio sources, also known as voices, are sampled and stored in memory. Examples of such voices are musical instruments and human voices. A collection of samples of one or more voices is commonly referred to as wavetable data.

Historically, wavetable music synthesizers have employed their own dedicated memory to store wavetable data. For example, a prior art wavetable music synthesizer may generally include one megabyte or more of Read Only Memory (ROM) to store wavetable data. This dedicated memory often represents a significant fraction of the total cost of a personal computer audio system.

Turning now to FIG. 1, a prior art computer system 100 including a CPU 101, a system memory 102, a chipset 104, and an audio card 120 are shown. Chipset 104 and audio card 120 are coupled to an Industry Standard Architecture (ISA) bus 106 commonly found in personal computers. Chipset 104 couples CPU 101, system memory 102 and ISA bus 106 together. Audio card 120 contains a dedicated ROM 122 for storing wavetable data. Audio card 120 employs wavetable synthesis on the data contained in the dedicated wavetable data ROM 122 in response to commands from CPU 101 to generate sound through speakers 108. One example of such an audio card 120 is the Sound Canvas product manufactured by Roland Corporation.

The cost of having a dedicated memory to store wavetable data could be eliminated by using the personal computer's system memory to store wavetable data. Applicant is aware of various unified memory architectures which attempt to store video data in the main or system memory. This approach has not been practical, however, because of bandwidth and bus mastering issues associated with the system bus.

Personal Computer system I/O buses have not provided enough bandwidth for a unified memory architecture implementation. A typical Industry Standard Architecture (ISA) bus implementation, for example, is only capable of sustaining a bandwidth of a few megabytes per second. As will be shown, a wavetable synthesizer would consume most, if not all, of this bandwidth leaving little or none for other functions in the system. With the advent of the Peripheral Component Interconnect (PCI) bus, this problem has been eliminated in that PCI bus implementations are capable of sustaining on the order of 100 MB/second.

The PCI bus, however, introduces some additional problems. Specifically, PCI is tied very closely with the PC's CPU. As a result the PCI bus has been optimized around the burst nature of refilling the CPU's cache memory. Further, the latency involved in gaining control of the PCI bus once a request for bus mastership is generated is both significant and indeterminate. PCI bus master latency is typically 2–3 microseconds, often 20–30 microseconds, and delays as long as 100–200 microseconds are possible.

A typical wavetable synthesizer can have multiple voices active simultaneously. The number of simultaneous active voices is referred to as the polyphony of the synthesizer. A wavetable synthesizer operates as a Digital Signal Processor (DSP) system, and as such has an associated sample rate hereinafter called the frame rate, which we will assume is 44,100 frames per second. During each frame time, which is the reciprocal of the frame rate (22.7 microseconds at a frame rate of 44,100 frames per second), the synthesizer must calculate a new output value for each of the active voices (up to 32 in our example). Assuming the polyphony is 32, this implies that the DSP hardware must process up to 44,100×32=1,411,200 voice outputs per second. To process a voice output, the DSP must fetch a pair of wavetable data samples from memory. If the wavetable data samples are stored in system memory, the synthesizer must fetch 2×1,411,200=2,822,400 data samples from system memory per second. Hence, the DSP must be fed with data at a rate of two samples every 708 nanoseconds. Since the data samples are typically one byte or two bytes wide the necessary bandwidth would be in excess of 5 MB/sec. Since the PCI bus has a theoretical burst bandwidth of 132 MB/sec (in a 32 bit wide PCI implementation, or 264 MB/sec in a 64 bit wide PCI implementation), bus bandwidth is not a problem in fetching the data over the PCI bus. However, problems arise due to the nature in which synthesizers generate addresses for the sample data.

One of the main functions of a wavetable synthesizer is to shift the pitch (frequency) of the stored wavetable data. The sound of a given voice is stored at one or more pitches in wavetable memory. To be of any use, the synthesizer must be able to play back all the notes the instrument is capable of playing. To do this, the pitch of one of the stored notes must be shifted from the stored value to the desired new value. This is performed by a process called interpolation, which involves interpolating new values between the stored wavetable sample to produce a new wavetable audio sample having a different pitch. Three key points about interpolation are relevant: 1) for each calculation, the synthesizer requires two data samples to interpolate between; 2) the addresses at which these samples are stored in wavetable memory are calculated as part of the interpolation process—that is to say, they are only available up to one frame time in advance of when the data is needed; and 3) successive samples are stored sequentially, but because of the interpolation process, it takes an indeterminate amount of time (as measured in frames) to step through a given number of samples.

As a further complication, to reduce the amount of wavetable data that must be stored, wavetable synthesizers can repetitively "loop" through the data samples. For example if a sine wave is to be played, only one cycle of the sine wave is stored in memory. The synthesizer starts at the beginning, steps through the various samples comprising the sine wave, then loops back to the beginning. Wavetable synthesizers typically can loop from end to beginning (forward), beginning to end (backward), and reverse direction (i.e., start at the beginning, move to the end, and then work backward in the opposite direction back through the data to the beginning). Hence, typically data can be fetched sequentially, but not always. Additionally, data must be able to be fetched sequentially by both incrementing and decrementing addresses.

SUMMARY OF THE INVENTION

The problems outlined above are in large part solved by a system and method for performing wavetable music synthesis which uses system memory to store wavetable data in accordance with the present invention. The system and method described herein utilizes the benefits of a high bandwidth I/O bus while mitigating the disadvantages introduced by having to arbitrate for a shared system bus. By using system memory for storing wavetable data, a more cost effective PC audio system can be produced.

In the preferred embodiment a computer system is provided that includes a system memory, which has as one of its functions to store wavetable data samples, a PCI bus, and an integrated circuit which functions as a PCI-based audio synthesis device. The audio synthesis device includes a PCI bus interface, a synthesizer, and a plurality of buffers coupled to the PCI bus interface and the synthesizer. The buffers receive wavetable data samples from system memory. Each buffer has a characteristic sample depth and the number of buffers defines the polyphony of the synthesizer; i.e., the number of buffers defines the maximum number of voices which can simultaneously be active. Each active buffer corresponds to an active voice. The buffer sizes are preferably small to minimize the size of the integrated circuit die area, and thus the cost of the integrated circuit due to increased yield. Conversely, the buffer sizes are also preferably sufficiently large to minimize the rate of PCI bus mastership requests and to maximize the allowed latency of obtaining PCI bus mastership.

The audio synthesis device also includes a buffer manager which controls the operation of the buffers. The buffer manager, in conjunction with the buffer depth, maximizes allowed PCI bus latency by maintaining a highest sample pointer for each buffer and requests PCI bus mastership to generate a request to fill the active buffers when the pointer has reached a predetermined threshold, that is, when the buffers have become a predetermined amount empty. By filling all active buffers at the same time, the device minimizes the total number of PCI bus mastership requests to a manageable value. The buffer manager is also capable of individually flushing and refilling an individual buffer, typically in response to looping or activating of a new voice.

Additionally, the audio synthesis device includes a plurality of write-back buffers coupled to the PCI bus interface, the buffer manager, and the synthesizer, for effects processing. The synthesizer is operable to read a plurality of wavetable data samples from one location in system memory through the plurality of buffers and write the plurality of wavetable data samples back to a different location in system memory through the plurality of write-back buffers.

Broadly speaking the present invention contemplates a computer system and method for performing wavetable music synthesis comprising a system memory which stores wavetable data, an I/O bus coupled to the system memory, and a system audio device. The system audio device comprises an I/O bus interface coupled to the I/O bus, a synthesizer having a data path and an address generator which generates control signals comprising address and voice number signals to request the wavetable data in order to generate sounds, and a plurality of buffers coupled to the I/O bus interface and to the synthesizer data path for buffering the wavetable data from the system memory. Each of the plurality of buffers has a sample depth for storing a plurality of wavetable data samples, wherein the sample depth is predetermined to minimize total I/O bus mastership requests and maximize allowed I/O bus mastership latency. The system audio device further comprises a buffer manager coupled to the I/O bus interface, the synthesizer address generator, and the plurality of buffers, for managing transfers of the wavetable data from the system memory to the buffers to the synthesizer data path in response to the control signals from the synthesizer for the wavetable data. The synthesizer address generator generates a request for a new wavetable data sample, wherein the buffer manager determines if the new wavetable data sample resides in the plurality of buffers, wherein the buffer manager controls the plurality of buffers to output the new wavetable data sample if the new wavetable data sample resides in the plurality of buffers, wherein the buffer manager controls the I/O bus interface to fetch the new wavetable data sample from the system memory if the new wavetable data sample does not reside in the plurality of buffers.

BRIEF DESCRIPTION OF THE DRAWINGS

Other objects and advantages of the invention will become apparent upon reading the following detailed description and upon reference to the accompanying drawings in which.

Figure 1:
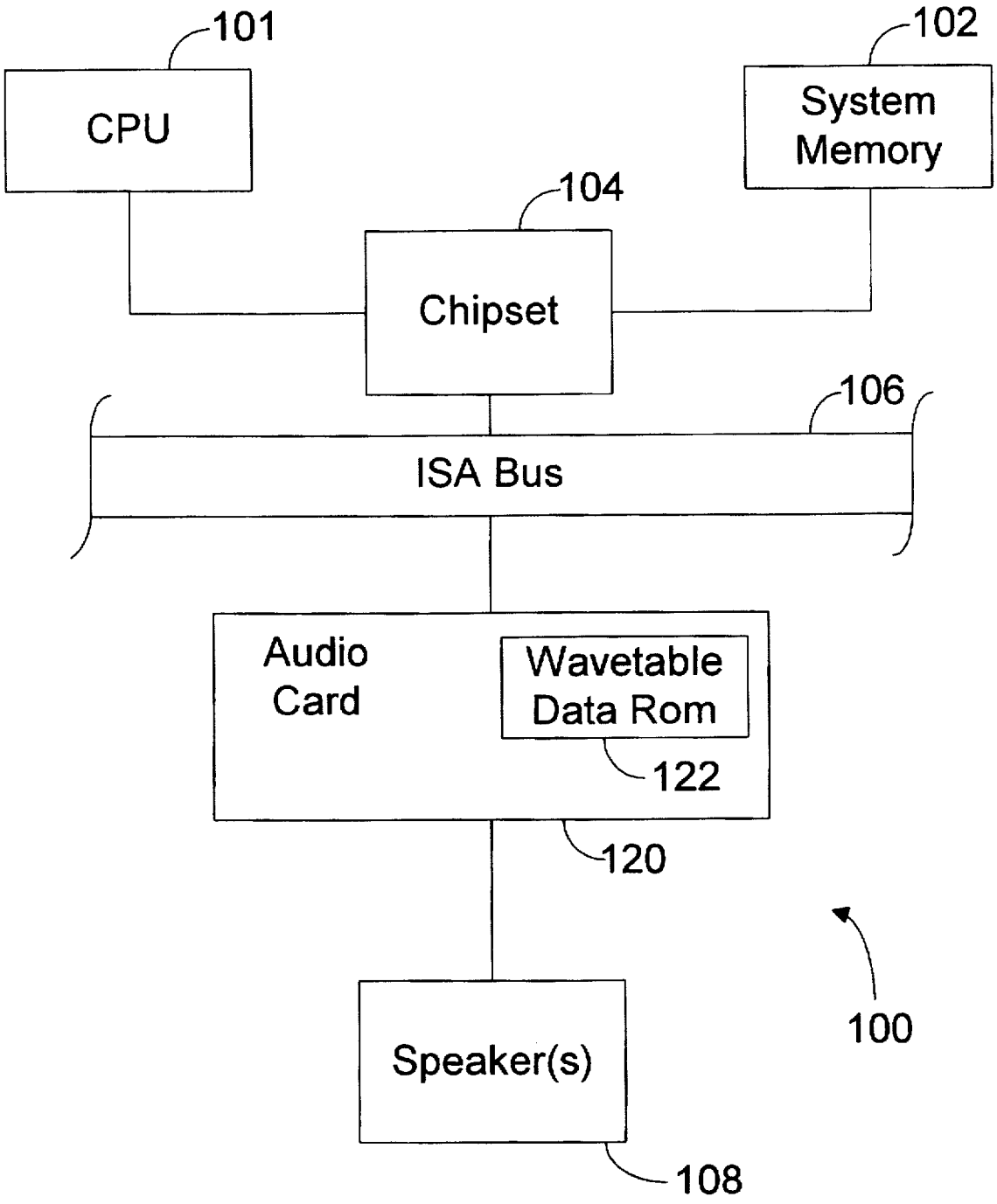
Fig. 1 (Prior Art)
FIG. 1 is a block diagram of a prior art computer system having an audio card which performs wavetable music synthesis.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Figure 2:
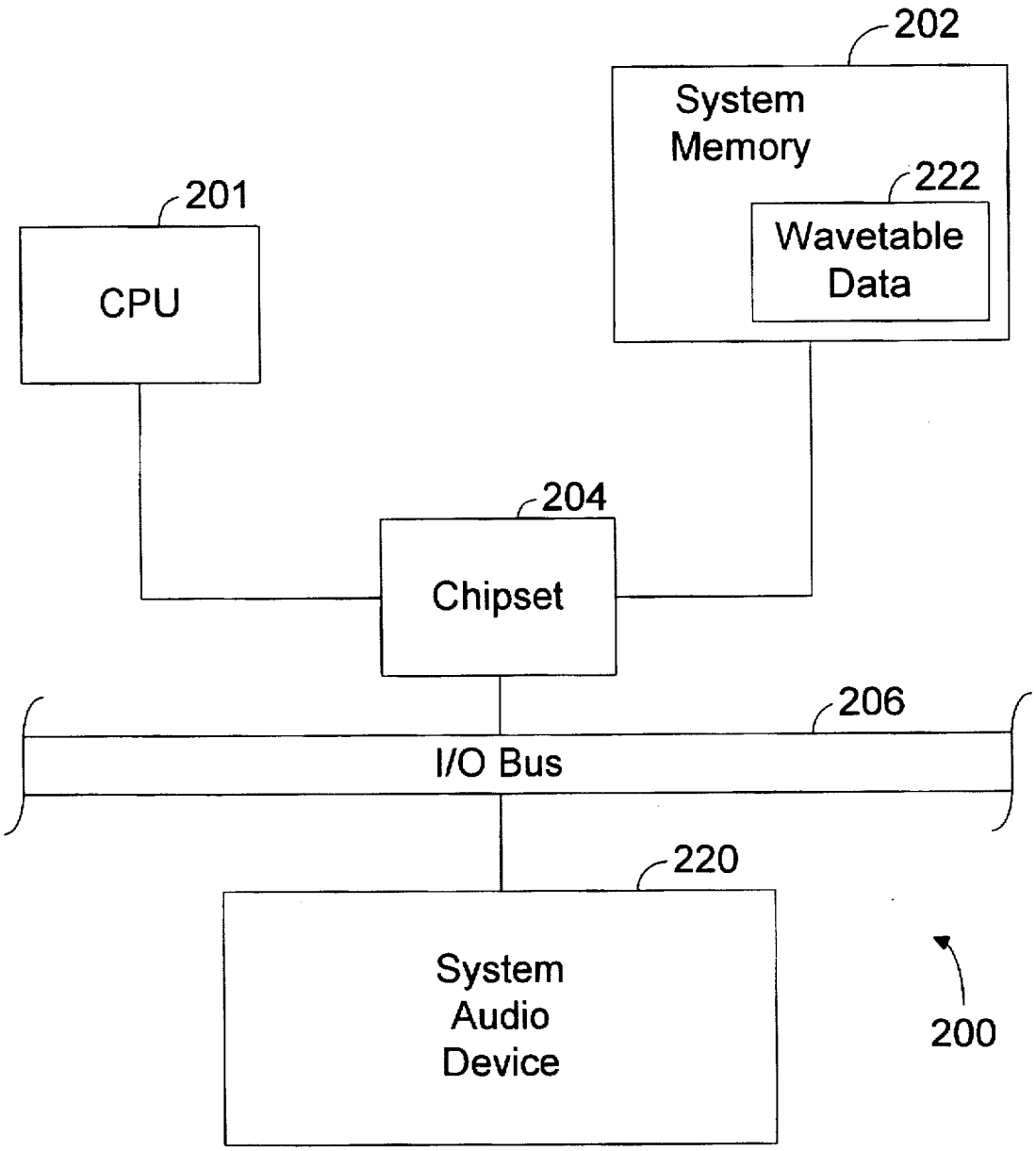
FIG. 2 is a block diagram of a computer system having a system audio device which performs wavetable music synthesis via wavetable data stored in the system memory.

Turning now to FIG. 2, a currently preferred embodiment of a computer system 200 according to the present invention is shown. The computer system 200 includes a CPU 201, a system memory 202, a chipset 204, and a system audio device 220. Chipset 204 and audio device 220 are coupled to an I/O bus 206. Audio device 220 generates sound through an analog device such as speakers or headphones. According to the present invention, the system memory 202 stores wavetable data used by the audio device 220. The audio device 220 employs wavetable synthesis on the wavetable data 222 contained in system memory 202. Thus, the cost of a dedicated memory for storing wavetable data, as in the prior art embodiment of FIG. 1, is eliminated, thereby reducing the total cost of the system. However, storing wavetable data 222 in system memory rather than a dedicated memory introduces bandwidth problems with the I/O bus 206. The I/O bus 206 is a shared resource which is used by other components in the system, such as CPU 201, and other peripheral devices connected to the I/O bus 206. These devices must arbitrate for the I/O bus 206. This arbitration introduces a latency associated with fetching wavetable data samples. The present invention solves this problem as will be discussed shortly.

In one embodiment wavetable data 222 is initially contained in a permanent storage medium, such as a system disk drive. The wavetable audio data is transferred to system memory 202 prior to audio device 220 performing wavetable synthesis.

I/O bus 206 provides a sufficient bandwidth for samples of wavetable data 222 to be fetched at a rate to synthesize audio sound for a characteristic polyphony of voices at a characteristic frame rate. In the preferred embodiment the polyphony is 32 and the frame rate is 44,100 samples per second. In the preferred embodiment the audio device requires two samples of wavetable data per voice per frame time. In the preferred embodiment the width of a sample is 16 bits. Hence, in the preferred embodiment I/O bus 206 must be capable of sustaining 2,822,400 samples or 5,644,800 bytes per second of wavetable data transfer from system memory 202 to audio device 220 without significant impact on the performance of the PC system as a whole. In one embodiment, chipset 204 is the Triton Chipset made by Intel Corporation which is capable of sustaining data transfer rates in excess of 80 MB/sec.

Figure 3:
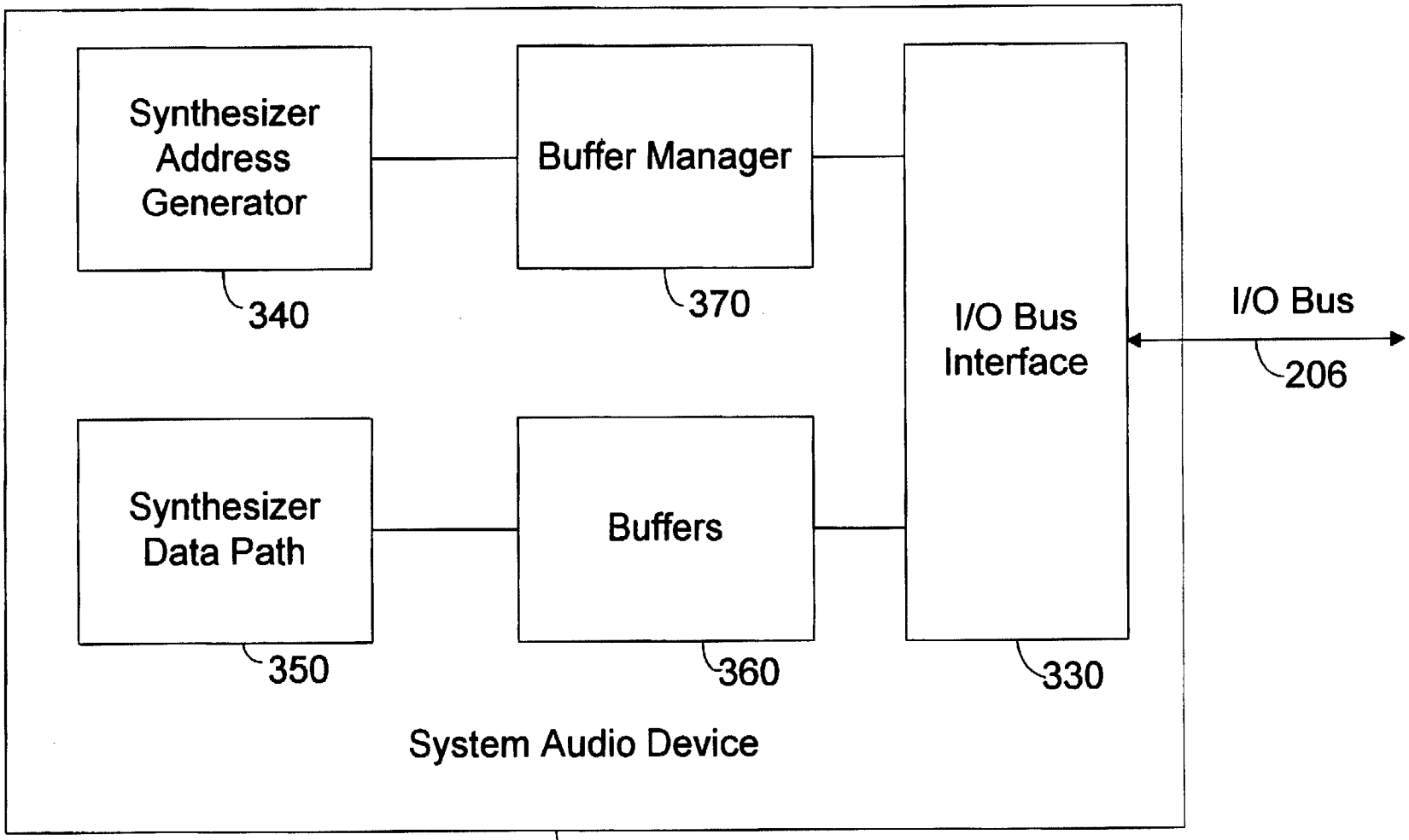
FIG. 3 is a block diagram illustrating more detailed portions of the system audio device shown in FIG. 2.

Turning now to FIG. 3, a block diagram of the preferred embodiment of audio device 220 of FIG. 2 is shown. Audio device 220 includes an I/O bus interface 330, a synthesizer address generator 340, a synthesizer data path 350, a plurality of buffers 360 and a buffer manager 370. The number of buffers 360 is equal to the number of voices which may be active simultaneously; i.e., each of buffers 360 corresponds to a voice. In the preferred embodiment this number is 32.

Synthesizer address generator 340 generates a request for two wavetable data samples each frame for each active voice. Synthesizer address generator 340 generates these requests one frame time before the samples are needed by synthesizer data path 350. Typically synthesizer address generator 340 generates requests for samples sequentially. In the preferred embodiment data samples for a given voice are stored sequentially in system memory 202. Hence, buffer manager 370 advantageously prefetches wavetable data samples for active voices into buffers 360 in anticipation of sequential requests from synthesizer address generator 340. In other words, buffer manager 370 fills buffers 360 in a predetermined fashion in order to avoid I/O bus latencies associated with fetching the samples. In the preferred embodiment the depth of each of buffers 360 is 10 and buffer manager 370 prefetches the number of samples of data required to fill the buffers for each active voice when the first active voice uses its eighth sample; i.e. when only 2 samples remain in the respective buffer. If synthesizer data path 350 does not receive the requested data sample by the time the synthesizer has used up the two sample pad (10–8=2) the synthesizer outputs its last calculated value until the new data sample becomes available. Hence, buffers 360 minimize the impact of conditions where I/O bus latencies are large.

The synthesizer data path 350 comprises DSP hardware that performs operations typical of normal wavetable synthesizers including pitch interpolation, volume envelope generation, panning, etc.

I/O bus interface 330 arbitrates for, gains mastership of, and fetches wavetable data samples across I/O bus 206 into buffers 360 in response to requests from buffer manager 370.

In the preferred embodiment buffer manager 370 attempts to fill buffers 360 for all active voices in a given I/O bus 206 mastership, and thus minimizes the number of I/O bus 206 mastership requests per second and improves overall system performance. Accordingly, as can readily be observed, the greater the number of samples which can be prefetched into buffers 360 the fewer the number of I/O bus 206 mastership requests per second which audio device 220 must make. However, it should be noted that increasing the depth of buffers 360 increases the die size of the integrated circuit embodying audio device 220 and thus increases its cost.

Figure 4:
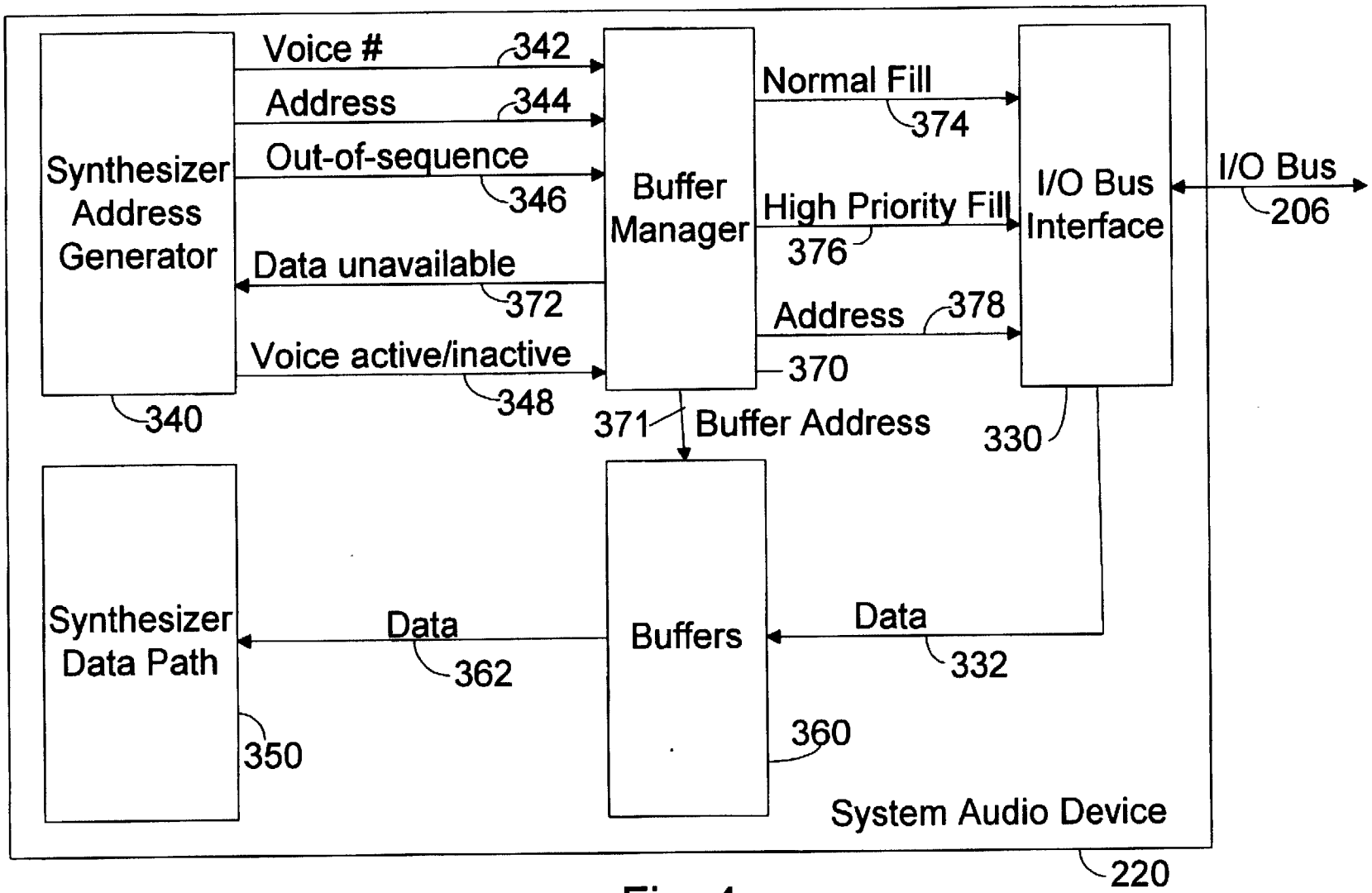
FIG. 4 is a block diagram illustrating more detailed portions of the system audio device shown in FIG. 3.

Turning now to FIG. 4, a block diagram of the preferred embodiment of audio device 220 of FIG. 3 is shown. Synthesizer address generator 340 generates requests for wavetable data samples to buffer manager 370 via voice number signals 342 and address signals 344. Address signals 344 specify the address in system memory of the desired wavetable data samples. Voice number signals 342 specify the voice number associated with the wavetable data samples. Synthesizer address generator 340 asserts out-of-sequence signal 346 to indicated that a given request is for a wavetable data sample which does not have a sequential address with the previous request. Synthesizer address generator 340 asserts voice active/inactive signal 348 which allows buffer manager 370 to determine that a new voice, the voice specified by voice number signals 342, has become active. Synthesizer address generator 340 generates a request for a pair of wavetable data samples to buffer manager 370 once per frame for each active voice.

When buffer manager 370 receives a request for wavetable data samples from synthesizer address generator 340 it determines whether the requested samples reside in buffers 360. If so, buffer manager 370 passes the requested samples from buffers 360 to synthesizer data path 350 on data bus 362 specified by buffer address 371. Buffer address 371 consists of two components, a voice number component and a buffer position component. The voice number component indicates which buffer within buffers 360 contains the requested samples. The buffer position component specifies which entry within the specified buffer contains the samples. In the preferred embodiment 5 bits are used to specify the voice number, thus providing the ability to specify 32 different voice numbers. In the preferred embodiment 4 bits are used to specify the buffer position, thus providing the ability to specify 10 locations within a buffer with a depth of 10.

If buffer manager 370 determines that the samples requested by synthesizer address generator 340 do not reside in buffers 360, buffer manager 370 asserts high priority fill request signal 376, i.e., generates a high priority fill request. In response to this assertion, I/O bus interface 330 arbitrates for and obtains mastership of I/O bus 206. Once I/O bus interface 330 obtains mastership of I/O bus 206 buffer manager 370 fills the buffer in buffers 360 corresponding to the voice number associated with the high priority request with wavetable data samples from system memory. These samples are specified by address signals 378 which are passed to I/O bus 206 by I/O bus interface 330. The samples are transferred from system memory on I/O bus 206, through I/O bus interface 330, onto data bus 332 and into buffers 360.

In the event that I/O bus interface 330 is unable to obtain mastership of I/O bus 206 within a desired frame time latency, buffer manager 370 asserts data unavailable signal 372 to notify synthesizer address generator 340 that the requested data sample was unavailable. If synthesizer data path 350 does not receive the requested data sample within the desired frame time the synthesizer outputs its last calculated value until the new data sample becomes available.

As mentioned in the description of FIG. 3, buffer manager 370 prefetches wavetable data samples in a sequential fashion. When buffer manager 370 determines such a fill, denoted as a normal fill request, of buffers 360 is required buffer manager 370 asserts normal fill request signal 374. In response to this assertion, I/O bus interface 330 arbitrates for and obtains mastership of I/O bus 206. Once I/O bus interface 330 obtains mastership of I/O bus 206 buffer manager 370 fills all of buffers 360 which correspond to active voices. In the event that a high priority fill request and a normal fill request are simultaneously pending when I/O bus interface 206 obtains bus mastership buffer manager 370 performs a fill associated with the high priority fill request before performing a fill associated with the normal fill request.

In the preferred embodiment I/O bus 206 is the PCI bus. As of revision 2.1 of the PCI specification, no provision exists for a high priority bus mastership request. However, it is noted that such a capability could be added to the specification in the future. It is further noted that the present invention is susceptible to implementations with other I/O buses, including future buses, which may in fact implement a high priority bus mastership request capability. In such a case, the invention described herein would advantageously employ such a capability.

Figure 5:
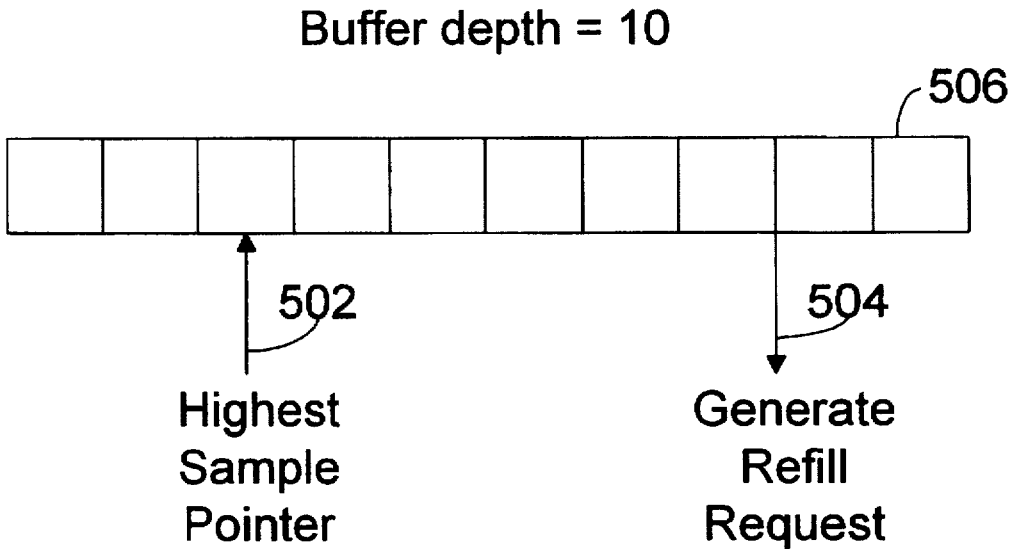
FIG. 5 is an illustration of a means of maintaining buffer location pointers for determining when to generate a buffer fill request.

Turning now to FIG. 5, an illustration of a buffer 506 is shown. Buffer 506 is exemplary of plurality of buffers 360 in FIGS. 3 and 4. In the embodiment shown, buffer 506 has a depth of 10, i.e., has 10 sample locations. Buffer manager 370 maintains a highest sample pointer 502 which points to the next available sample in buffer 506. Each time buffer 506 passes a new (higher numbered) sample to synthesizer data path 350, buffer manager 370 updates highest sample pointer 502 to point to the next available sample. When highest sample pointer 502 points to a predetermined generate fill request location 504, buffer manager 370 asserts normal fill request signal 374. In the preferred embodiment, generate fill request location 504 is where 2 samples remain in buffer 506. It is noted that various depths of buffer 506 and generate fill request location 504 may be realized and in describing the embodiment shown it is not the intention to preclude any such other variations.

Figure 6:
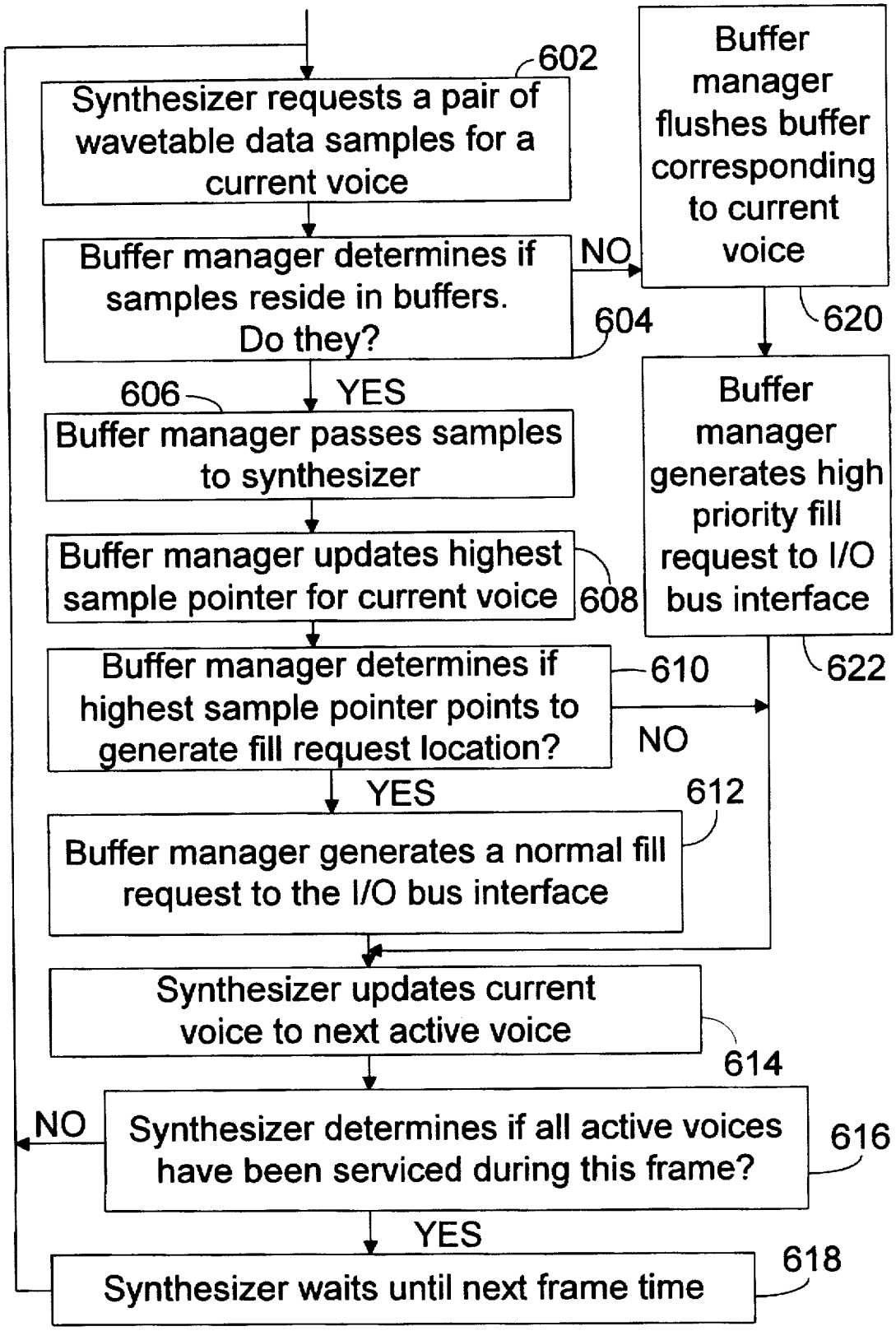
FIGS. 6, 7 and 8 are flowcharts illustrating some of the steps which the system audio device takes in performing wavetable music synthesis.

Turning now to FIG. 6, a flowchart illustrating steps which the present audio device invention takes in performing wavetable synthesis is shown. During normal operation, the synthesizer of the audio device requests a pair of wavetable data samples from the buffer manager of the audio device for a current voice in step 602. The synthesizer later takes these samples, performs interpolation on them, and generates musical notes or sounds with the calculated values. After the synthesizer requests samples in step 602, the buffer manager determines whether or not the requested samples reside in the plurality of buffers of the audio device in step 604. If the buffer manager determines that the samples do reside in the buffers then the buffer manager passes the samples on to the synthesizer in step 606. Otherwise, if the buffer manager determines that the samples do not reside in the buffers the buffer manager flushes the buffer associated with the current voice in step 620 and afterwards generates a high priority fill request to the I/O bus interface of the audio device in step 622.

After the buffer manager passes the samples on to the synthesizer in step 606, the buffer manager conditionally updates the highest sample pointer for the buffer associated with the current voice in step 608 to reflect the fact that the samples were passed to the synthesizer in step 606. After the buffer manager updates the highest sample pointer in step 608 the buffer manager determines if the updated highest sample pointer points to the generate fill request location in the buffer associated with the current voice in step 610. If the buffer manager determines in step 610 that the highest sample pointer in fact points to the generate fill request location the buffer manager generates a normal fill request to the I/O bus interface in step 612.

Meanwhile, the synthesizer, after requesting a pair of wavetable data samples in step 602 updates the current voice to the next active voice in step 614. By way of example, if voice number 17 was the current voice and voice 18 was inactive and voice 19 was active then in step 614 the synthesizer would update the current voice from 17 to 19. The buffer manager updates the current voice modulo the polyphony of the synthesizer. In other words if the voices were numbered 1 through 32, for example, and the current voice number was 32, and voice 1 was active, then in step 614 the synthesizer would update the current voice from 32 to 1. After the synthesizer updates the current voice in step 614 the synthesizer determines if all active voices have been serviced within the current frame time in step 616. In other words, the synthesizer fetches samples for each active voice only once per frame time. Therefore, if the synthesizer determines that it has not fetched samples for all the active voices in this frame in step 616 it will return to step 602 and repeat the process until it has fetched samples for all the active voices in this frame. Once the synthesizer determines in step 616 that samples have been fetched for all active voices in this frame the synthesizer waits until the start of the next frame time in step 618 and then returns to step 602 to start the process over again for all of the active voices in the next frame.

Figure 7:
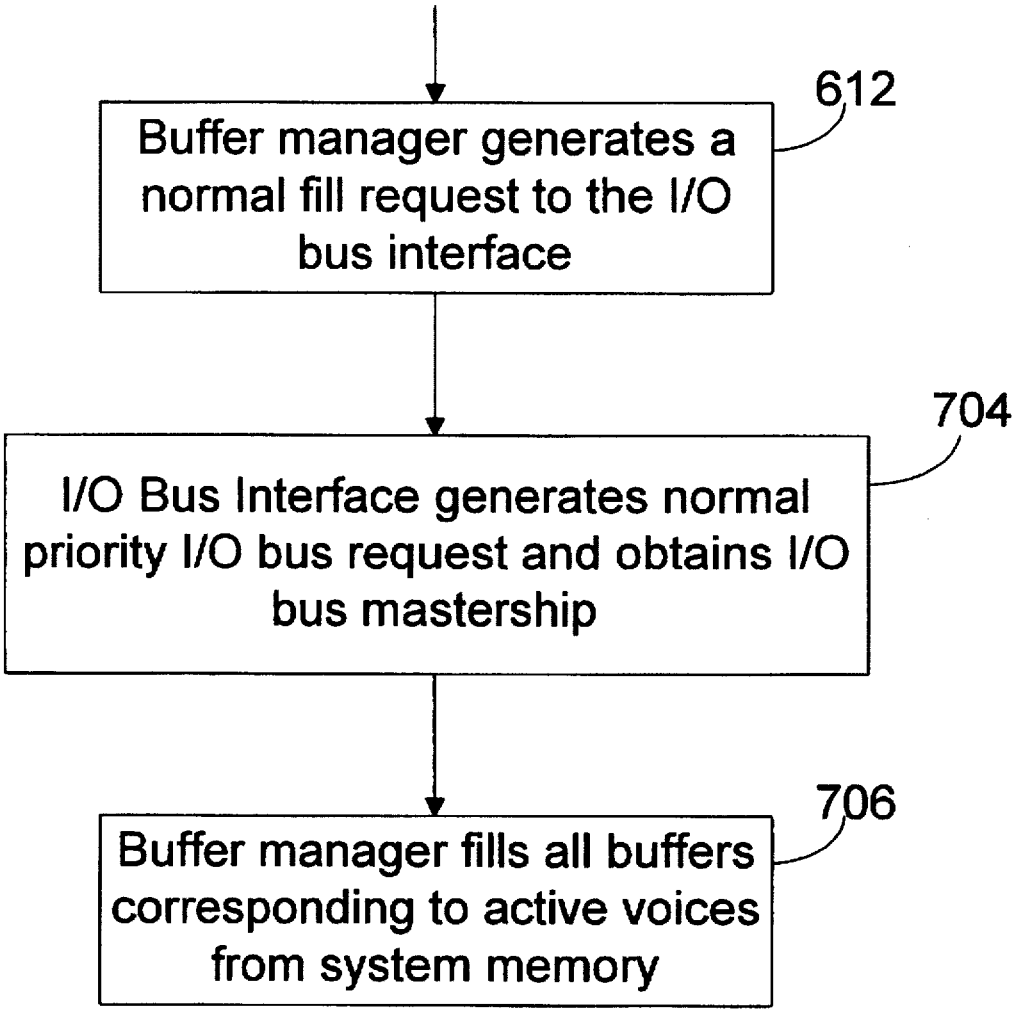

Turning now to FIG. 7, a flowchart illustrating steps which the present audio device invention takes in performing wavetable synthesis is shown. As was previously discussed regarding FIG. 6, in step 612 the buffer manager generates a normal fill request to the I/O bus interface as the result of having determined in step 610 that a fill of the active voices was needed. After the buffer manager generates a normal fill request to the I/O bus interface in step 612 the I/O bus interface arbitrates for the I/O bus and obtains bus mastership of the I/O bus in step 704. After the I/O bus interface obtains mastership of the I/O bus the buffer manager fills the active buffers with the appropriate wavetable data samples from the system memory in step 706. As previously discussed, this prefetching, in anticipation of sequential requests from the synthesizer address generator, advantageously avoids I/O bus latencies associated with fetching the samples from system memory.

Figure 8:
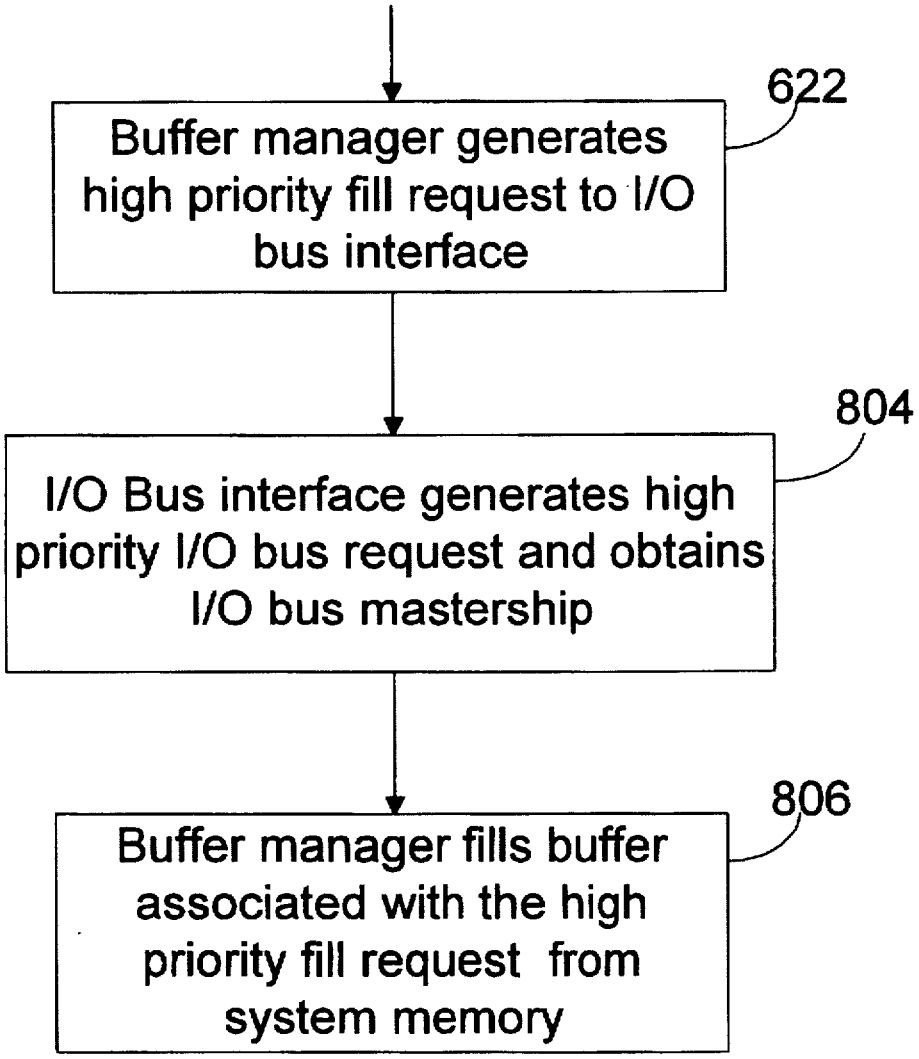

Turning now to FIG. 8, a flowchart illustrating steps which the present audio device invention takes in performing wavetable synthesis is shown. As was previously discussed regarding FIG. 6, in step 622 the buffer manager generates a high priority fill request to the I/O bus interface as the result of having determined in step 604 that the samples requested by the synthesizer in step 602 did not reside in the buffers. After the buffer manager generates a high priority fill request to the I/O bus interface in step 622 the I/O bus interface arbitrates for the I/O bus and obtains bus mastership of the I/O bus in step 804. After the I/O bus interface obtains mastership of the I/O bus the buffer manager fills the buffer associated with the high priority fill request with the appropriate wavetable data samples from the system memory in step 806. As previously discussed, if the I/O bus interface is unable to obtain ownership of the I/O bus and the samples requested by the synthesizer cannot be transferred from system memory to the synthesizer within a frame time due long I/O bus latencies then the synthesizer must output its last calculated value. This results in loss of audio fidelity. Hence, the preferred embodiment of the present invention fills buffers associated with high priority fill requests before normal fill requests. An additional consideration is that a normal fill request may not be able to be completed in a single bus mastership. Therefore, the preferred embodiment of the present invention performs high priority fill requests before normal priority fill requests.

Figure 9:
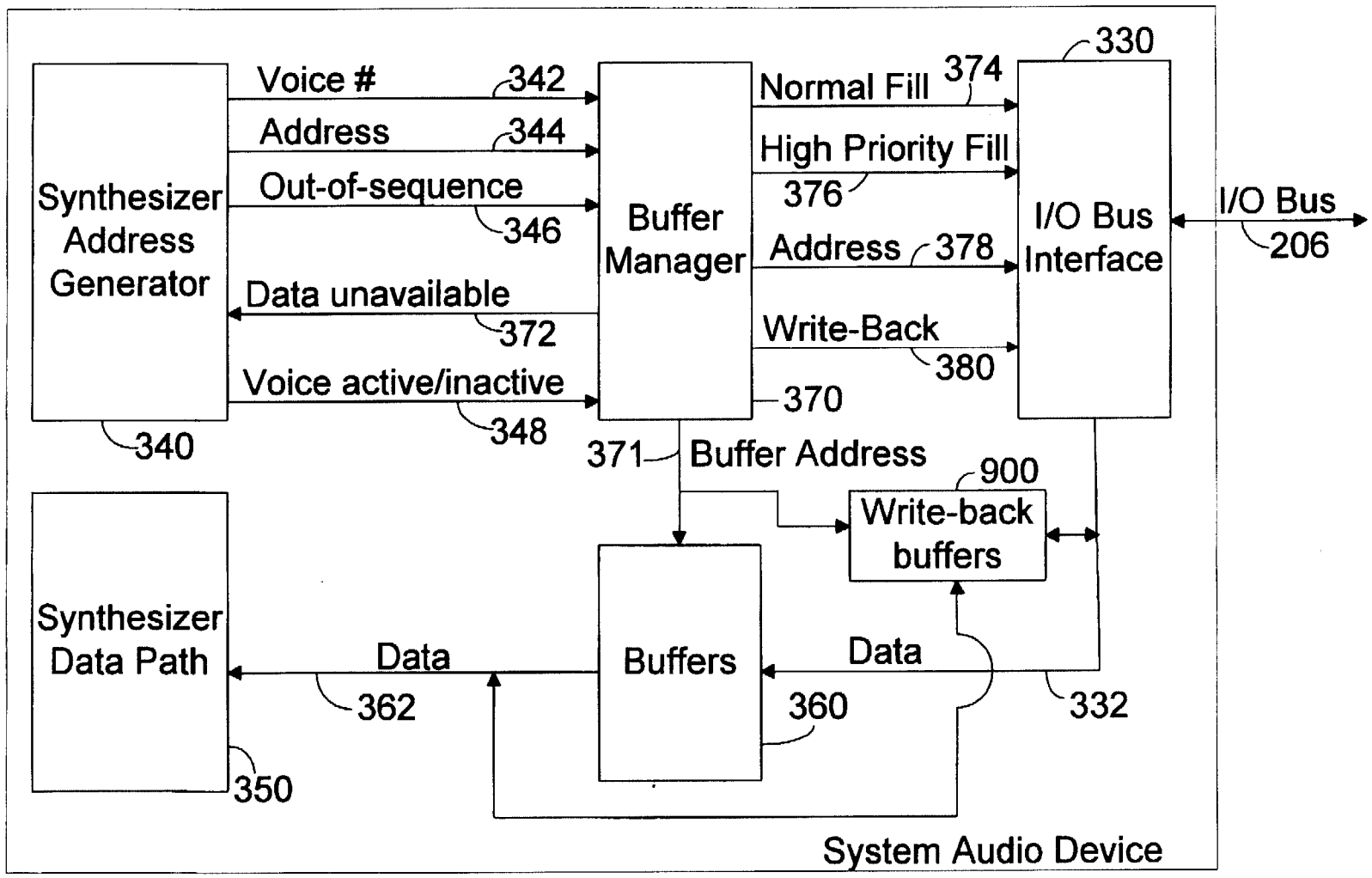
FIG. 9 is similar to that of FIG. 4 and in addition illustrating a set of write-back buffers for effects processing.

Turning now to FIG. 9, a block diagram of a second embodiment of audio device 220 of FIG. 3 is shown. The embodiment of FIG. 9 is similar to that of FIG. 4, and corresponding circuit portions are numbered identically for simplicity and clarity. The embodiment of FIG. 9 contemplates, in addition to the embodiment of FIG. 4, a plurality of write-back buffers 900. Buffers 900 are coupled to I/O bus interface 330, synthesizer data path 350 and buffer manager 370. System audio device 220 dedicates one of more buffers 360 to generating delay-based effects, such as reverb or echo. System audio device 220 advantageously employs buffers 900 in that, once per frame per dedicated effects voice, synthesizer address generator 340 reads a wavetable data sample from one location in system memory through buffers 360 and writes the sample back to a different location in system memory through one of write-back buffers 900. Buffer manager 370 performs the writes from buffers 900 back to system memory in a fashion so as to minimize the number of bus mastership requests which I/O bus interface 330 must make and to maximize the allowed I/O bus mastership latency of the I/O bus in a manner similar to that which the buffer manager employs for buffers 360, as mentioned in the discussion of FIG. 4, regarding maintaining sample pointers. In this case, buffer manager 370 writes back the data in buffers 900 when buffers 900 become a predetermined amount full. In the preferred embodiment the number of write-back buffers is 8 and each write-back buffer has a depth of 10 samples and buffer manager 370 performs writes back to system memory when a first voice becomes 8 samples full.

Numerous variations and modifications will become apparent to those skilled in the art once the above disclosure is fully appreciated. It is intended that the following claims be interpreted to embrace all such variations and modifications.

What is claimed is:

1. A computer system for performing wavetable music synthesis comprising:

a system memory, said system memory storing wavetable data;

an I/O bus coupled to said system memory; and a system audio device comprising:

an I/O bus interface coupled to said I/O bus;

a synthesizer having a data path and an address generator, said synthesizer address generator generating a request comprising control signals, said control signals comprising address and voice number signals to request said wavetable data, wherein said synthesizer generates sounds in response to said wavetable data;

a plurality of buffers coupled to said I/O bus interface and to said synthesizer data path for buffering said wavetable data from said system memory, each of said plurality of buffers having a sample depth for storing a plurality of wavetable data samples; and a buffer manager coupled to said I/O bus interface, said synthesizer address generator, and said plurality of buffers, for managing transfers of said wavetable data from said system memory to said buffers; wherein said wavetable data is transferred from said buffers to said synthesizer data path in response to said control signals from said synthesizer for said wavetable data.

2. The system of claim 1 wherein said synthesizer address generator generates a request for a plurality of new wavetable data samples, wherein said buffer manager determines if said plurality of new wavetable data samples resides in said plurality of buffers, wherein said buffer manager controls said plurality of buffers to output said plurality of new wavetable data samples if said plurality of new wavetable data samples resides in said plurality of buffers, wherein said buffer manager controls said I/O bus interface to fetch said plurality of new wavetable data samples from said system memory if said plurality of new wavetable data samples does not reside in said plurality of buffers.

3. The system of claim 1 wherein said synthesizer has a characteristic polyphony, wherein said synthesizer simultaneously plays a first plurality of voices, wherein said plurality of buffers comprises a first plurality of buffers, wherein said first plurality of buffers corresponds to said first plurality of voices.

4. The system of claim 3 wherein said polyphony is 32.

5. The system of claim 1 wherein said buffer manager further generates buffer address signals to said plurality of buffers, said buffer address signals having a voice number component and a buffer position component, wherein said voice number component of said buffer address signals is used to indicate a first buffer within said plurality of buffers containing a requested wavetable data sample and said buffer position component of said buffer address signals is used to indicate a location within said first buffer containing said requested wavetable data sample.

6. The system of claim 1 wherein said buffer manager generates a normal fill signal to said I/O bus interface for requesting said I/O bus interface to generate a normal priority I/O bus mastership, and said buffer manager generates a high priority fill signal to said I/O bus interface for requesting said I/O interface to generate a high priority I/O bus mastership.

7. The system of claim 1 wherein said buffer manager generates a data unavailable signal, indicating that a plurality of new wavetable data samples does not reside in said plurality of buffers, and said buffer manager is unable to retrieve said plurality of new wavetable data samples from said system memory into said plurality of buffers within a desired frame time latency;

wherein said buffer manager asserts said data unavailable signal, wherein said synthesizer outputs its last calculated value in response to said data unavailable signal until said plurality of new wavetable data samples becomes available.

8. The system of claim 1 wherein said buffer manager further maintains a highest sample pointer for each of said plurality of buffers which points to a highest sample in each of said plurality of buffers, wherein said buffer manager determines if one or more of said highest sample pointers points to a generate refill request location, wherein said generate fill request location indicates that one of said plurality of buffers is a predetermined amount empty, wherein said buffer manager refills all of said plurality of buffers which are active if said highest sample pointer for a first of said plurality of buffers points to said generate fill request location for said first of said plurality of buffers.

9. The system of claim 1 wherein said control signals generated by said synthesizer address generator further comprise an out-of-sequence signal, wherein said synthesizer is operable to loop through a plurality of wavetable data samples, wherein said buffer manager individually flushes and refills one of said buffers corresponding to a voice specified by said synthesizer address generator voice number signals in response to said out-of-sequence signal being asserted.

10. The system of claim 1 wherein said control signals generated by said synthesizer further comprise a voice active/inactive signal, wherein said synthesizer is operable to activate a new voice, wherein said buffer manager individually flushes and refills one of said buffers corresponding to a voice specified by said synthesizer address generator voice number signals in response to said voice active/inactive signal.

11. The system of claim 1 wherein said I/O bus is the PCI bus.

12. The system of claim 1 wherein said sample depth is 10.

13. The system of claim 1 wherein said system audio device further comprises a plurality of write-back buffers coupled to said I/O bus interface, said buffer manager and said data path of said synthesizer for effects processing, each of said plurality of write-back buffers having a write-back buffer depth, wherein said synthesizer reads a plurality of wavetable data samples from a first location in said system memory through said plurality of buffers and writes said plurality of wavetable data samples back to a second location in said system memory through said plurality of write-back buffers.

14. The system of claim 13 wherein said plurality of write-back buffers is 8 and said write-back buffer depth is 10.

15. A method of performing wavetable music synthesis in a system comprising a system memory storing wavetable data samples, an I/O bus, and a system audio device, said system audio device having an I/O bus interface coupled to said I/O bus, a synthesizer, a plurality of buffers coupled to said I/O bus interface and said synthesizer, and a buffer manager coupled to said I/O bus interface, said synthesizer, and said plurality of buffers, comprising:

said synthesizer requesting a pair of wavetable data samples for a current voice;

said buffer manager determining if said wavetable data samples reside in said plurality of buffers after said synthesizer requesting samples;

said buffer manager passing said wavetable data samples from said plurality of buffers to said synthesizer if said buffer manager determines said wavetable data samples reside in said plurality of buffers;

said buffer manager retrieving said wavetable data samples from said system memory and providing said wavetable data samples to said synthesizer if said buffer manager determines said samples do not reside in said plurality of buffers.

16. The method of claim 15 further comprising:

said buffer manager updating a highest sample pointer associated with one of said plurality of buffers associated with said current voice after said buffer manager passing said wavetable data samples;

said buffer manager determining if said highest sample pointer points to a generate fill request location after said buffer manager updating;

said buffer manager generating a normal fill request to said I/O interface if said buffer manager determines said highest sample pointer points to a generate fill request location.

17. The method of claim 15 further comprising:

said buffer manager flushing one of said plurality of buffers corresponding to said current voice if said buffer manager determines said wavetable data samples do not reside in said plurality of buffers;

said buffer manager generating a high priority fill request to said I/O interface after said buffer manager flushing.

18. The method of claim 16 further comprising:

said I/O interface obtaining I/O bus mastership after said buffer manager generating a normal fill request to said I/O interface;

said buffer manager filling from said system memory all of said plurality of buffers corresponding to active voices after said I/O interface obtaining I/O bus mastership.

19. The method of claim 17 further comprising:

said I/O interface obtaining I/O bus mastership after said buffer manager generating a high priority fill request to said I/O interface;

said buffer manager filling from system memory one of said plurality of buffers corresponding to said current voice associated with said high priority fill request after said I/O interface obtaining I/O bus mastership.

20. The method of claim 15 wherein said synthesizer performs said synthesizer requesting, and said buffer manager performs said buffer manager determining, said buffer manager passing and said buffer manager retrieving for each active voice in a current frame time.

21. The method of claim 15 wherein said synthesizer requesting a pair of wavetable data samples for a current voice is for an out-of-sequence pair of wavetable data samples.

22. The method of claim 15 wherein said synthesizer requesting a pair of wavetable data samples for a current voice is for a newly activated voice.

23. A method of performing wavetable music synthesis in a system comprising a system memory storing wavetable data samples, an I/O bus, and a system audio device, said system audio device having an I/O bus interface coupled to said I/O bus, a synthesizer, a plurality of buffers coupled to said I/O bus interface and said synthesizer, and a buffer manager coupled to said I/O bus interface, said synthesizer, and said plurality of buffers, comprising:

said synthesizer requesting a pair of wavetable data samples for a current voice;

said buffer manager determining if said wavetable data samples reside in said plurality of buffers after said synthesizer requesting samples;

said buffer manager passing said wavetable data samples from said plurality of buffers to said synthesizer if said buffer manager determines said wavetable data samples reside in said plurality of buffers;

said buffer manager updating a highest sample pointer associated with one of said plurality of buffers associated with said current voice after said buffer manager passing said wavetable data samples;

said buffer manager determining if said highest sample pointer points to a generate fill request location after said buffer manager updating;

said buffer manager generating a normal fill request to said I/O interface if said buffer manager determines said highest sample pointer points to a generate fill request location;

said buffer manager flushing one of said plurality of buffers corresponding to said current voice if said buffer manager determines said wavetable data samples do not reside in said plurality of buffers;

said buffer manager generating a high priority fill request to said I/O interface after said buffer manager flushing;

said synthesizer updating said current voice to a next active voice after said synthesizer requesting samples;

said synthesizer determining if all active voices have been serviced in a current frame time after said synthesizer updating;

said synthesizer returning to said synthesizer requesting samples if said synthesizer determines all active voices have not been serviced in said current frame time;

said synthesizer waiting until a next frame time if said synthesizer determines all active voices have been serviced in said current frame time;

said synthesizer returning to said synthesizer requesting samples after said synthesizer waiting.

24. A computer system for performing wavetable music synthesis comprising:

a system memory, said system memory storing wavetable data;

an I/O bus coupled to said system memory; and a system audio device comprising:

an I/O bus interface coupled to said I/O bus;

a synthesizer coupled to said I/O bus interface, said synthesizer generating a request to said I/O bus interface comprising control signals, said control signals comprising address and voice number signals to request said wavetable data from said system memory, wherein said synthesizer generates sounds in response to said wavetable data.

* * * * *